US010519828B2

(12) United States Patent
Williams et al.

(10) Patent No.: US 10,519,828 B2
(45) Date of Patent: Dec. 31, 2019

(54) DRONE ELIMINATION MUFFLER

(71) Applicant: K&N Engineering, Inc., Riverside, CA (US)

(72) Inventors: Steve Williams, Beaumont, CA (US); Kevin McClelland, Rancho Cucamonga, CA (US)

(73) Assignee: K&N Engineering, Inc., Riverside, CA (US)

( * ) Notice: Subject to any disclaimer, the term of this patent is extended or adjusted under 35 U.S.C. 154(b) by 0 days.

(21) Appl. No.: 15/427,892

(22) Filed: Feb. 8, 2017

(65) Prior Publication Data

US 2017/0145882 A1 May 25, 2017

Related U.S. Application Data

(63) Continuation of application No. 15/094,788, filed on Apr. 8, 2016, now Pat. No. 9,587,535.

(60) Provisional application No. 62/145,031, filed on Apr. 9, 2015.

(51) Int. Cl.

| | |
|---|---|
| ***F01N 1/02*** | (2006.01) |
| ***F01N 1/16*** | (2006.01) |
| ***F01N 1/06*** | (2006.01) |
| ***F01N 1/08*** | (2006.01) |
| ***G10K 11/04*** | (2006.01) |
| *G10K 11/16* | (2006.01) |

(52) U.S. Cl.

CPC ..... *F01N 1/023* (2013.01); *F01N 1/02* (2013.01); *F01N 1/06* (2013.01); *F01N 1/082* (2013.01); *F01N 1/163* (2013.01); *G10K 11/04* (2013.01); *F01N 2560/06* (2013.01); *G10K 11/161* (2013.01)

(58) Field of Classification Search

CPC ..... F01N 1/163; F01N 2490/14; F01N 13/04
USPC ..... 181/206, 250, 253, 254
See application file for complete search history.

(56) References Cited

U.S. PATENT DOCUMENTS 3,146,850 A * 9/1964 Ludlow ..... F01N 1/006 138/37
3,263,772 A * 8/1966 Irwin ..... F01N 1/02 181/227
3,402,785 A * 9/1968 Heath ..... F01N 1/006 181/250

(Continued)

FOREIGN PATENT DOCUMENTS

JP 05001532 A * 1/1993 ..... F01N 13/1811

*Primary Examiner* — Jeremy A Luks
(74) *Attorney, Agent, or Firm* — Rutan & Tucker LLP; Hani Z. Sayed

(57) ABSTRACT

An apparatus and method are provided for a drone elimination muffler to attenuate drone exhibited by engine exhaust systems. The drone elimination muffler comprises a hollow canister having a length and a diameter, and a tuned port comprising a first end connected to the canister and a second end connected to the exhaust system. The canister operates in concert with the tuned port as a dampener configured to substantially attenuate exhaust drone, or resonance, at one or more frequencies of engine operation. A valve is configured to switch the drone elimination muffler between a closed state in which the exhaust system operates without acoustic influence due to the drone elimination muffler, and an open state in which the drone elimination muffler directly influences the acoustic properties of the exhaust system.

16 Claims, 8 Drawing Sheets

(56) References Cited

U.S. PATENT DOCUMENTS

| | | | | | |
|---|---|---|---|---|---|
| 3,415,338 | A * | 12/1968 | McMillan | F01N 1/06 | 181/227 |
| 4,924,966 | A * | 5/1990 | Kanda | F01N 1/02 | 181/228 |
| 5,167,430 | A * | 12/1992 | Bainbridge | F01N 13/1811 | 181/222 |
| 5,189,266 | A * | 2/1993 | Sasaki | F01N 1/16 | 181/227 |
| 5,388,408 | A * | 2/1995 | Lawrence | B60K 13/04 | 181/228 |
| 7,240,769 | B2 * | 7/2007 | Nezan | F01N 1/003 | 181/250 |
| 7,464,789 | B2 * | 12/2008 | Yamamoto | F01N 1/089 | 181/212 |
| 8,453,792 | B2 * | 6/2013 | Wirth | B60K 13/04 | 181/250 |
| 9,587,535 | B2 * | 3/2017 | Williams | F01N 1/163 | |
| 2007/0227807 | A1 * | 10/2007 | Meneely | F01N 1/02 | 181/237 |
| 2010/0307143 | A1 * | 12/2010 | Colette | F01N 1/003 | 60/299 |
| 2012/0260626 | A1 * | 10/2012 | Colette | F01N 1/003 | 60/273 |
| 2015/0247433 | A1 * | 9/2015 | Colette | F01N 1/023 | 60/273 |
| 2015/0255054 | A1 * | 9/2015 | Keck | G10H 5/10 | 381/61 |

* cited by examiner

FIG. 2A
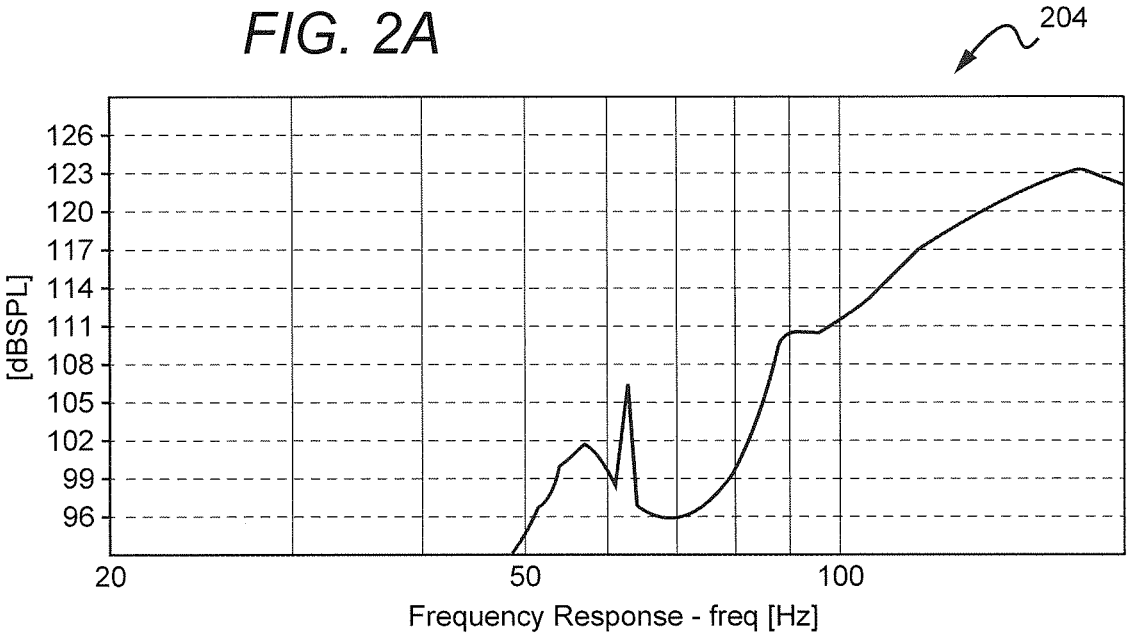
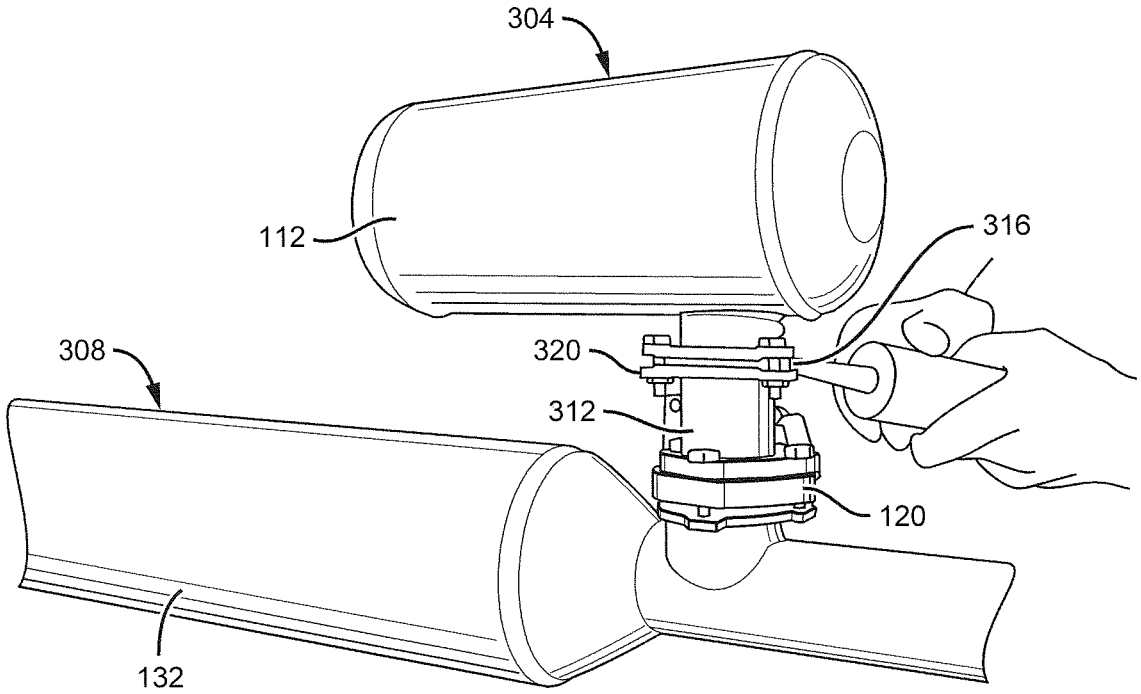
FIG. 3

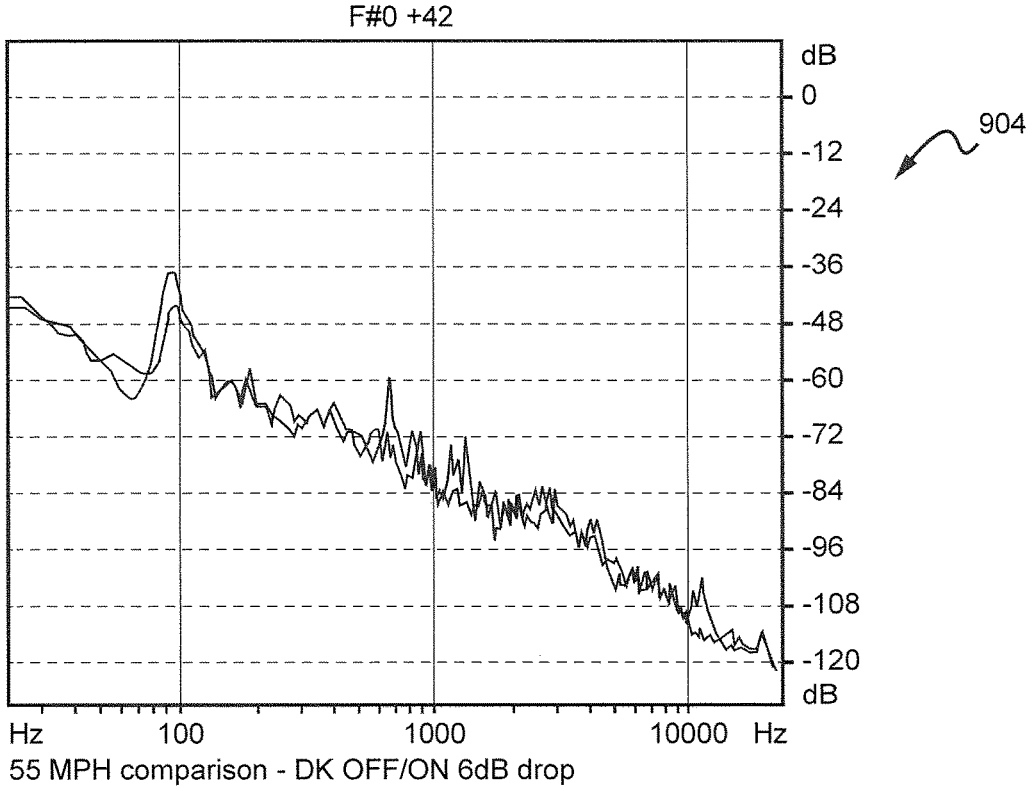
FIG. 9A
FIG. 9B
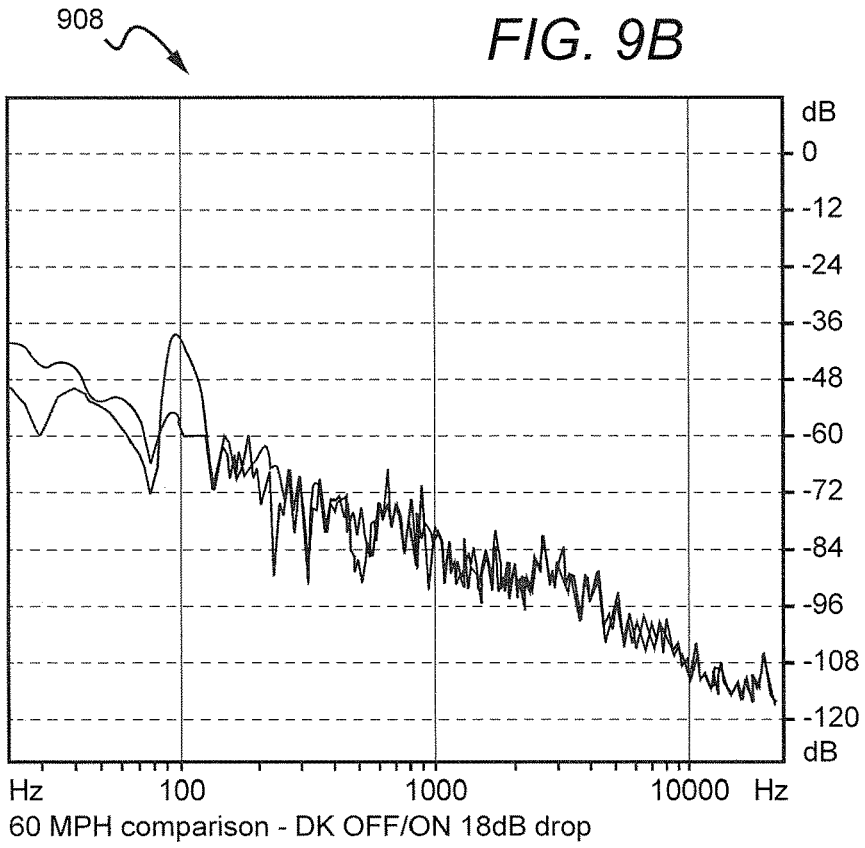

DRONE ELIMINATION MUFFLER

PRIORITY

This application claims the benefit of and priority to U.S. Provisional Application, entitled "Drone Elimination Muffler," filed on Apr. 9, 2015 having application Ser. No. 62/145,031.

FIELD

The field of the present disclosure generally relates to engine exhaust systems. More particularly, the field of the invention relates to an apparatus and a method for a drone elimination muffler to attenuate exhaust drone, or resonance, at one or more frequencies of engine operation.

BACKGROUND

Exhaust drone may be described as a deep, constant bass-like sound, or a resonating sound that rattles the interior of a vehicle at certain engine speeds. Expressed differently, exhaust drone occurs when the frequency of vibration of an exhaust system matches a natural frequency of vibration of the entire vehicle, resulting in a loud resonating sound that varies with engine speed. In some cases, exhaust drone can be loud enough to stifle conversation, or listening to the radio within the passenger compartment of the vehicle.

Exhaust drone tends to be more prevalent with aftermarket, or performance exhaust systems, particularly those exhaust systems in which the components comprising the system have been welded together. Attempting to eliminate exhaust drone can be time consuming and difficult, and often requires a trial and error approach to resolve. What is needed, therefore, is a device and a method for dampening, or attenuating, those certain acoustic frequencies within exhaust systems that give rise to exhaust drone.

SUMMARY

An apparatus and method are provided for a drone elimination muffler to attenuate drone exhibited by engine exhaust systems. The drone elimination muffler comprises a hollow canister having a length and a diameter, and a tuned port comprising a first end connected to the canister and a second end connected to the exhaust system. The canister operates in concert with the tuned port as a dampener configured to substantially attenuate exhaust drone, or resonance, at one or more frequencies of engine operation. A valve is configured to switch the drone elimination muffler between a closed state in which the exhaust system operates in absence of the drone elimination muffler, and an open state in which the drone elimination muffler directly influences the acoustic properties of the exhaust system. In some embodiments, a first thermocouple is in thermal contact with the tuned port, and a second thermocouple is in thermal contact with the canister. The first and second thermocouples are configured to respectively detect the temperature of the tuned port and the canister. In some embodiments, the first and second thermocouples are configured to respectively monitor the temperature of the tuned port and the canister so as to facilitate maximizing attenuation of drone in the exhaust system during exhaust gas temperature changes.

In an exemplary embodiments, an apparatus comprises a drone elimination muffler to attenuate drone exhibited by exhaust systems. The drone elimination muffler comprises a canister comprising a hollow cylindrical body having a length and a diameter; and a tuned port comprising a first end connected to the canister and a second end connected to the exhaust system, such that the canister and the tuned port operate in concert as a dampener configured to substantially attenuate exhaust drone at one or more frequencies of engine operation.

In another exemplary embodiment, the second end is connected to the exhaust system between a catalytic converter and a muffler, such that the tuned port and the canister are in fluid communication with the exhaust system. In another exemplary embodiment, the length is substantially 12 inches and the diameter is substantially 6 inches, and the tuned port comprises a length selected so as to attenuate a frequency of substantially 100 Hertz (Hz).

In another exemplary embodiment, the second end is connected to the exhaust system at an outlet of the muffler. In another exemplary embodiment, the tuned port comprises a short, side mounted tuned port and a damper clamped within a joint between the canister and the exhaust system. In another exemplary embodiment, the damper comprises a 40% open perforated stainless steel sheet.

In another exemplary embodiment, a valve is disposed between the second end and the exhaust system so as to enable switching the drone elimination muffler between a closed state in which the exhaust system operates without acoustic influence due to the drone elimination muffler, and an open state in which the drone elimination muffler directly influences the acoustic properties of the exhaust system. In another exemplary embodiment, a first thermocouple is in thermal contact with the tuned port, and a second thermocouple is in thermal contact with the canister, the first and second thermocouples being configured to respectively detect a temperature of the tuned port and a temperature of the canister. In another exemplary embodiment, the first and second thermocouples are configured to respectively monitor the temperature of the tuned port and the canister so as to facilitate maximizing attenuation of drone in the exhaust system during exhaust gas temperature changes.

In an exemplary embodiments, a method for attenuating drone exhibited by an exhaust system of an internal combustion engine comprises providing a hollow canister having a length and a diameter suitable for use in a drone elimination muffler; selecting a tuned port having a length and diameter suitable for operating in concert with the hollow canister to attenuate exhaust drone; and connecting a first end of the tuned port to the canister and connecting a second end of the tuned port to the exhaust system, such that the canister and the tuned port substantially attenuate exhaust drone at one or more frequencies of engine operation.

In another exemplary embodiment, selecting the tuned port further comprises accounting for effects due to an operating temperature, or a temperature range, of the exhaust system. In another exemplary embodiment, providing the hollow canister further comprises maximizing a size of the drone elimination muffler so as to increase an effective bandwidth of attenuation.

In another exemplary embodiment, the method further comprises ensuring a natural frequency of the drone elimination muffler is substantially equal to an excitation frequency of the exhaust system so as to optimize attenuation of drone exhibited by the exhaust system. In another exemplary embodiment, the method further comprises ensuring the dimensions of the drone elimination muffler do not exceed substantially a quarter wavelength of the natural frequency of the drone elimination muffler so as to minimize any effects due to standing waves within the hollow canister.

In another exemplary embodiment, selecting the tuned port further comprises clamping a damper within a joint between the hollow canister and the exhaust system, the damper comprising at least a 40% open perforated stainless steel sheet. In another exemplary embodiment, the method further comprises placing a first thermocouple in thermal contact with the tuned port, and placing a second thermocouple in thermal contact with the hollow canister, the first and second thermocouples being configured to respectively detect a temperature of the tuned port and a temperature of the hollow canister. In another exemplary embodiment, the method further comprises configuring the first and second thermocouples to respectively monitor the temperature of the tuned port and the hollow canister for the purpose of optimizing attenuation of drone in the exhaust system during exhaust gas temperature changes.

In another exemplary embodiment, the method further comprises incorporating a valve into the second end of the tuned port so as to enable switching the drone elimination muffler between a closed state in which the exhaust system operates in absence of influence due to the drone elimination muffler, and an open state in which the drone elimination muffler attenuates drone exhibited by the exhaust system. In another exemplary embodiment, the method further comprises coupling the drone elimination muffler with a source of secondary noise so as to control exhaust drone by way of destructive acoustic interference. In another exemplary embodiment, the method further comprises coupling any of pistons, springs, baffles, rings, dampers, joints, and the like, with the drone elimination muffler so as to optimize drone attenuation across a range of operating speeds of the internal combustion engine.

BRIEF DESCRIPTION OF THE DRAWINGS

The drawings refer to embodiments of the present disclosure in which:

FIG. 2A is a graph illustrating acoustic data acquired from the drone elimination muffler illustrated in FIG. 1 operating at room temperature, according to the present disclosure;

FIG. 3 illustrates a perspective view of an exemplary embodiment of a drone elimination muffler being prepared for installation into a test vehicle in accordance with the present disclosure;

FIG. 9A is a graph illustrating a comparison of acoustic data acquired from a test vehicle comprising the drone elimination muffler illustrated in FIG. 3 in the closed state and the open state while the test vehicle operates at 55 MPH, in accordance with the present disclosure;

FIG. 9B is a graph illustrating a comparison of acoustic data acquired from a test vehicle comprising the drone elimination muffler illustrated in FIG. 3 in the closed state and the open state while the test vehicle operates at 60 MPH in accordance with the present disclosure.

Figure 1:
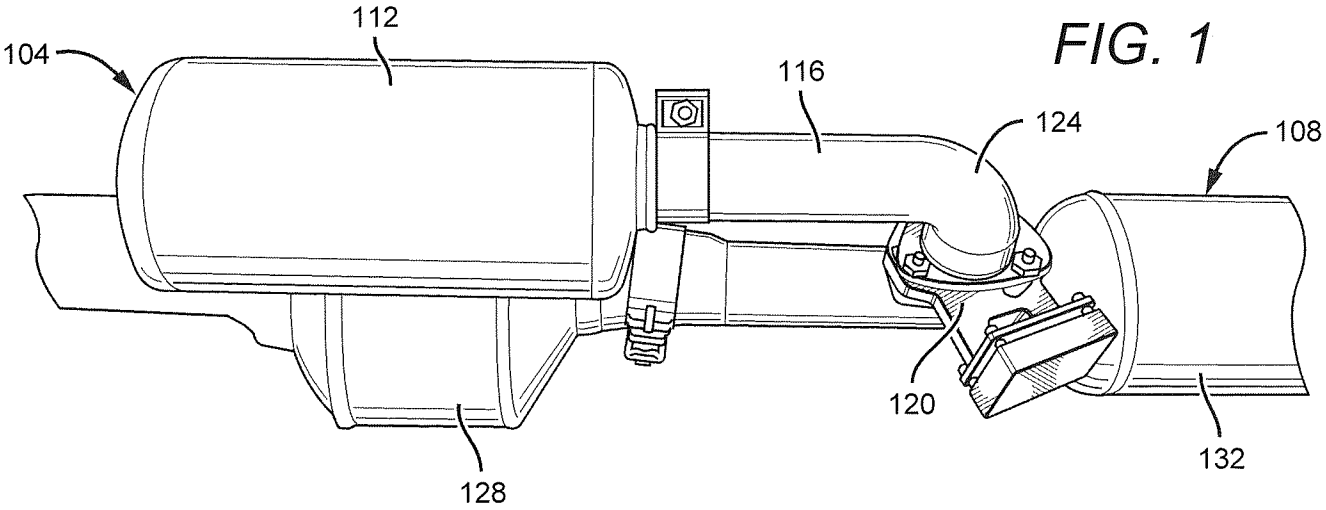
FIG. 1 illustrates a perspective view of an embodiment of a drone elimination muffler installed in an exemplary exhaust system, according to the present disclosure.

While the present disclosure is subject to various modifications and alternative forms, specific embodiments thereof have been shown by way of example in the drawings and will herein be described in detail. The invention should be understood to not be limited to the particular forms disclosed, but on the contrary, the intention is to cover all modifications, equivalents, and alternatives falling within the spirit and scope of the present disclosure.

DETAILED DESCRIPTION

In the following description, numerous specific details are set forth in order to provide a thorough understanding of the present disclosure. It will be apparent, however, to one of ordinary skill in the art that the invention disclosed herein may be practiced without these specific details. In other instances, specific numeric references such as "first valve," may be made. However, the specific numeric reference should not be interpreted as a literal sequential order but rather interpreted that the "first valve" is different than a "second valve." Thus, the specific details set forth are merely exemplary. The specific details may be varied from and still be contemplated to be within the spirit and scope of the present disclosure. The term "coupled" is defined as meaning connected either directly to the component or indirectly to the component through another component. Further, as used herein, the terms "about," "approximately," or "substantially" for any numerical values or ranges indicate a suitable dimensional tolerance that allows the part or collection of components to function for its intended purpose as described herein.

In general, the present disclosure describes an apparatus and a method for a drone elimination muffler to attenuate drone exhibited by engine exhaust systems. The drone elimination muffler comprises a hollow canister having a length and a diameter, and a tuned port comprising a first end connected to the canister and a second end connected to the exhaust system. The canister operates in concert with the tuned port as a dampener configured to substantially attenuate exhaust drone, or resonance, at one or more frequencies of engine operation. A valve is configured to switch the drone elimination muffler between a closed state in which the exhaust system operates in absence of the drone elimination muffler, and an open state in which the drone elimination muffler directly influences the acoustic properties of the exhaust system. In some embodiments, a first thermocouple is in thermal contact with the tuned port, and a second thermocouple is in thermal contact with the canister. The first and second thermocouples are configured to respectively detect the temperature of the tuned port and the canister. In some embodiments, the first and second thermocouples are configured to respectively monitor the temperature of the tuned port and the canister so as to facilitate maximizing attenuation of drone in the exhaust system during exhaust gas temperature changes.

FIG. 1 illustrates a perspective view of an embodiment of a drone elimination muffler 104 in an exemplary exhaust system 108, according to the present disclosure. The drone elimination muffler 104 comprises a hollow canister 112, comprising a length and a diameter, which is installed into the exhaust system 108 by way of a tuned port 116 and a valve 120. As shown in FIG. 1, a first end of the tuned port 116 is connected to the canister 112 and a second end of the tuned port 116 is connected to the exhaust system 108 by way of the valve 120. The tuned port 116 further comprises a curved portion 124 which is connected to the exhaust system 108 between a catalytic converter 128 and a hotrod muffler 132. A first thermocouple (not shown) is in thermal contact with the curved portion 124, and a second thermocouple (not shown) is in thermal contact with the canister 112. During testing, the first thermocouple reached a temperature of substantially 250 degrees F. and the second thermocouple reached a temperature of 140 degrees F.

The valve 120 is configured to operably switch the drone elimination muffler 104 between a closed state and an open state. In the closed state, the valve 120 seals the tuned port 116 such that the exhaust system 108 operates normally in absence of any acoustic influence due to the drone elimination muffler 104. In the open state, the valve 120 unseals the tuned port 116, putting the tuned port 116 and the canister 112 in fluid communication with the exhaust system 108. In the open state, the drone elimination muffler 104 directly influences the acoustic properties of the exhaust system 108.

It will be appreciated by those skilled in the art that the embodiment illustrated in FIG. 1 is similar to a Helmholtz resonator which generally comprises a cavity connected to the system of interest through one or more short narrow tubes. The Helmholtz resonator generally operates to reflect sound back to the source, thereby controlling the detectable sound-level emanating from the source. Although the Helmholtz resonator is advantageously simple, the frequency range over which the Helmholtz resonator is effective is relatively narrow. As a consequence, these devices need to be precisely tuned to the frequency of the noise source to achieve optimal attenuation.

As will be appreciated, the drone elimination muffler 104 effectively operates as an acoustic filter element. Drawing upon a mathematical treatment, if dimensions of the drone elimination muffler 104 are smaller than an acoustic wavelength within the exhaust system 108, then dynamic behavior of the drone elimination muffler 104 may be modeled mathematically as an oscillating mass on a spring. The volume of air within the canister 112 may be treated as the spring and the air in the tuned port 116 may be treated as the oscillating mass. Damping occurs in the form of radiation losses at the ends of the tuned port 116, and viscous losses occur due to friction of the oscillating air in the tune port 116. Thus, the canister 112 operates in concert with the tuned port 112 as a dampener so as to substantially eliminate, or attenuate, exhaust drone, or resonance, at one or more frequencies of engine operation. It will be further appreciated that the length and diameter of the canister 112, as well as the length and shape of the tuned port 116 predictably affect the acoustic properties of the drone elimination muffler 104. Thus, the shapes, sizes, and dimensions of the canister 112, the tuned port 116, and the curved portion 132 may be selected so as to tailor, or "tune," the drone elimination muffler 104 to dampen certain acoustic frequencies as desired.

Figure 2B:
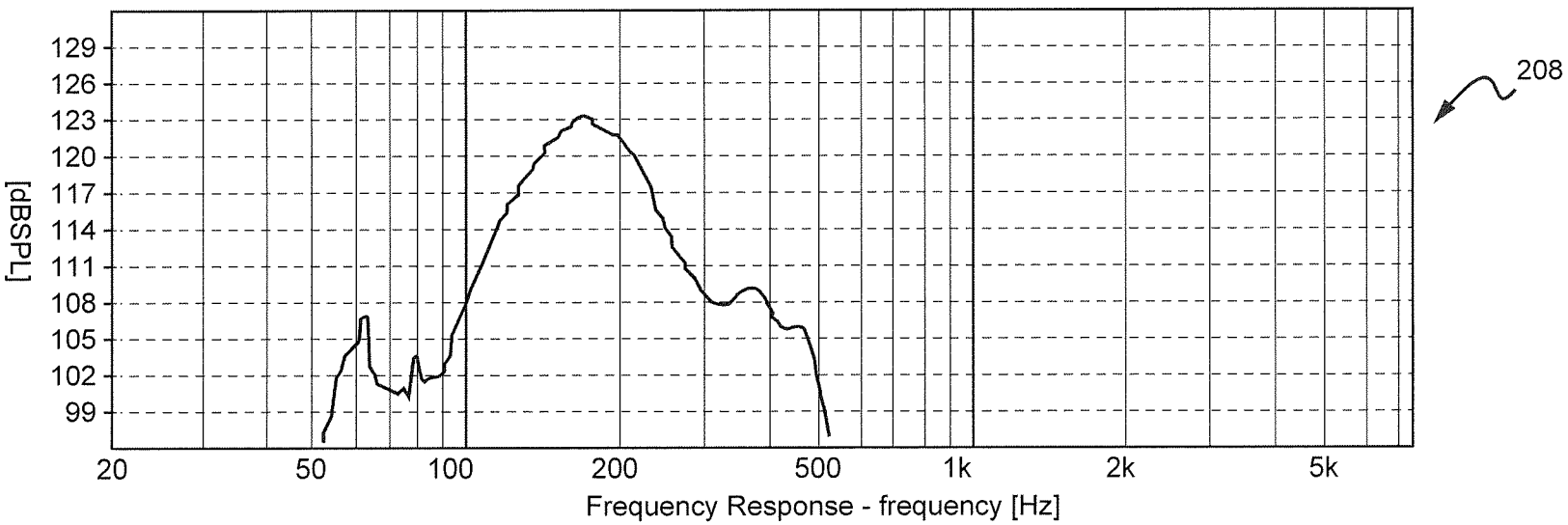
FIG. 2B is a graph illustrating acoustic data acquired from the drone elimination muffler illustrated in FIG. 1 operating at a temperature of substantially 400 degrees Fahrenheit (F) in accordance with the present disclosure.

In the embodiment illustrated in FIG. 1, the exhaust system 108 is installed onto a typical V8 engine, which is well known to produce exhaust drone with a frequency of about 100 Hertz (Hz) when operating at about 1500 revolutions per minute (RPM), occurring during typical highway cruising speeds. Thus, the canister 112 has a length of substantially 12 inches and a diameter of substantially 6 inches, and the tuned port 116 has a length selected so as to desirably attenuate a frequency of substantially 100 Hz. FIG. 2A is a graph 204 illustrating acoustic data acquired during bench testing of the drone elimination muffler 104 illustrated in FIG. 1. With an acoustic source positioned at an entrance of the exhaust system 108, a microphone positioned at an exit of the exhaust system 108, and the tuned port 116 at room temperature, the drone elimination muffler 104 was found to be tuned to an attenuation frequency of substantially 65 Hz. When the temperature is raised to substantially 400 degrees F., the attenuation frequency rises to about 80 Hz, as indicated in a graph 208 illustrated in FIG. 2B.

It will be appreciated, therefore, that in addition to the dimensions and shapes incorporated into the drone elimination muffler 104, an operating temperature, or a temperature range, must also be taken into account during designing of the drone elimination muffler 104. Further, it will be appreciated that an optimal attenuation of sound pressure generally occurs when a natural frequency of the drone elimination muffler 104 is substantially equal to an excitation frequency of the exhaust system 108. Thus, the drone elimination muffler should be made as large as possible so as to increase the effective bandwidth of attenuation. It should be understood, however, that in order to minimize any effects due to standing waves within the canister 112, the dimensions of the drone elimination muffler 104 must not exceed substantially a quarter wavelength of the natural frequency of the drone elimination muffler.

FIGS. 3 illustrates a perspective view of an exemplary embodiment of a drone elimination muffler 304 being installed into an exhaust system 308 in preparation for installation into a test vehicle in accordance with the present disclosure. The drone elimination muffler 304 is substantially similar to the drone elimination muffler 104 illustrated in FIG. 1, with the exception that the drone elimination muffler 304 comprises a short, side mounted tuned port 312 and a damper 316 comprising 40% open perforated stainless steel sheet clamped within a joint 320 between the canister 112 and the exhaust system 308. As shown in FIG. 3, in some embodiments, silicone may be used to seal the joint 320 and the damper 316 so as to maintain the original performance characteristics of the exhaust system 308.

Figure 4:
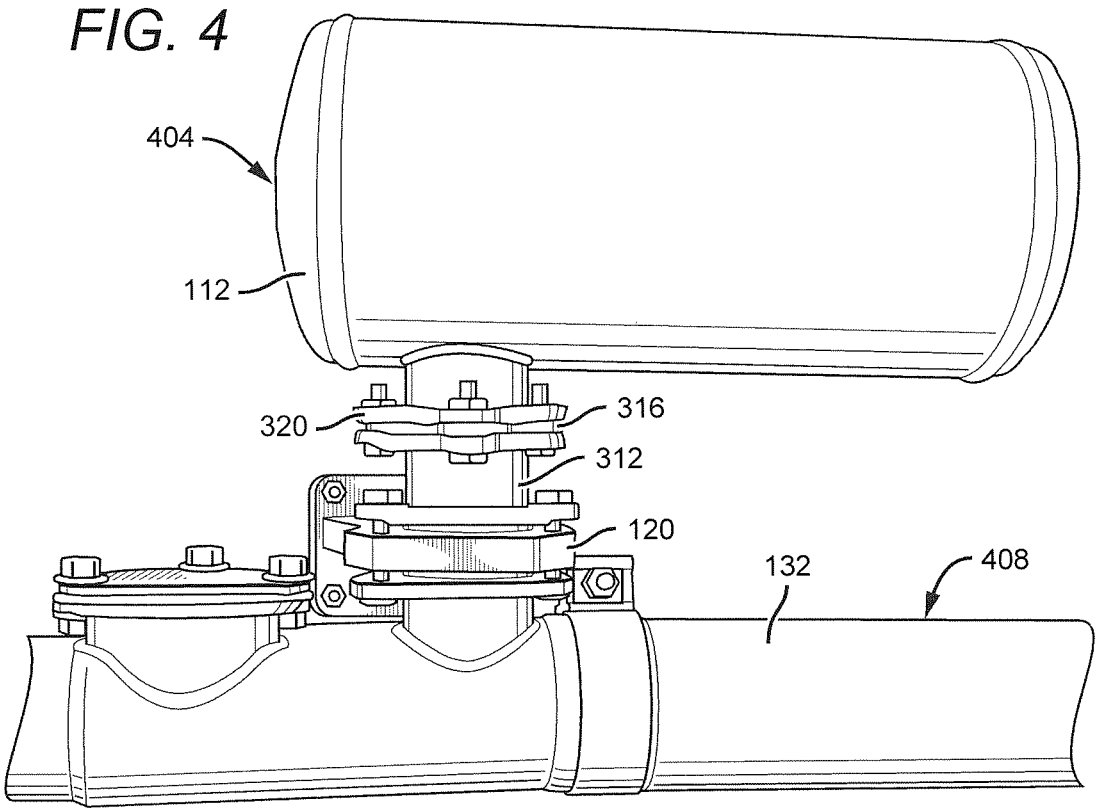
FIG. 4 illustrates a perspective view of an exemplary embodiment of a drone elimination muffler prepared for installation into a test vehicle in accordance with the present disclosure.

FIG. 4 illustrates a perspective view of an exemplary embodiment of a drone elimination muffler 404 installed into an exhaust system 408 in preparation for installation into a test vehicle in accordance with the present disclosure. The drone elimination muffler 404 is substantially similar to the drone elimination muffler 304 illustrated in FIG. 3, with the exception that the drone elimination muffler 404 is substantially 50% longer than the canister 112 illustrated in FIG. 3, and the drone elimination muffler 404 is installed at an outlet of the hotrod muffler 132. As will be appreciated, installing the drone elimination muffler 404 at the outlet of the muffler 132, rather than between the catalytic converter 128 and the muffler 132, gives rise to relatively different acoustic properties due to a lower exhaust gas temperature and a relatively shorter exhaust exit pipe. It should be understood, therefore, that the drone elimination mufflers 304, 404 may be practiced with a wide variety of shapes, sizes, and installation sites within engine exhaust systems without departing from the spirit and scope of the present disclosure.

With reference again to FIG. 3, in one embodiment, the exhaust system 308 comprises an exhaust system of a test vehicle with the drone elimination muffler 304 installed therein, as described above. During testing of the drone elimination muffler 304, the test vehicle was placed on a chassis dynamometer, and operated at test speeds of 50, 55, 60, 65, 70 and 75 MPH. At each test speed, acoustic data was collected with the valve 120 in the closed state and then in the opened state. Acoustic data was collected by way of a 4-channel digital recorder with two cardioid microphones and a studio microphone calibrated with a calibration tone at a frequency of substantially 1 kHz and a sound power level (SPL) of substantially 94 decibels (dB). The studio microphone was positioned on the right-hand side of the driver's headrest inside the test vehicle by way of a microphone stand. Further, an omnidirectional microphone was calibrated as described herein and positioned next to the studio microphone so as to collect and send acoustic data to acoustic analysis software operating on a laptop PC computer.

Figure 5A:
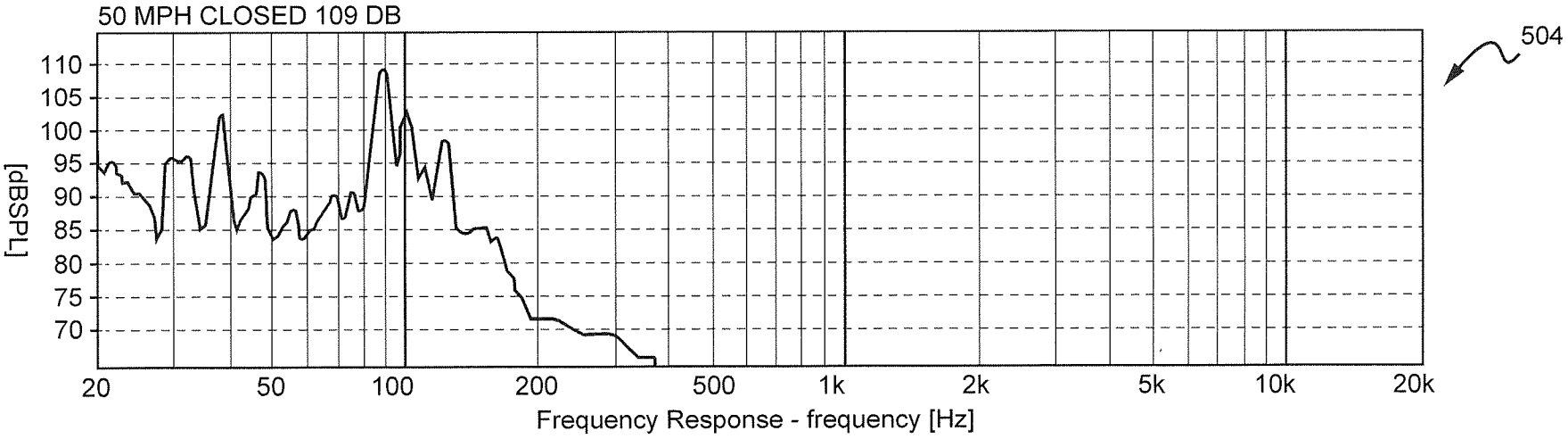
FIG. 5A is a graph illustrating acoustic data acquired from a test vehicle comprising the drone elimination muffler illustrated in FIG. 3 in a closed state while the test vehicle operates at 50 miles per hour (MPH) in accordance with the present disclosure.
Figure 5B:
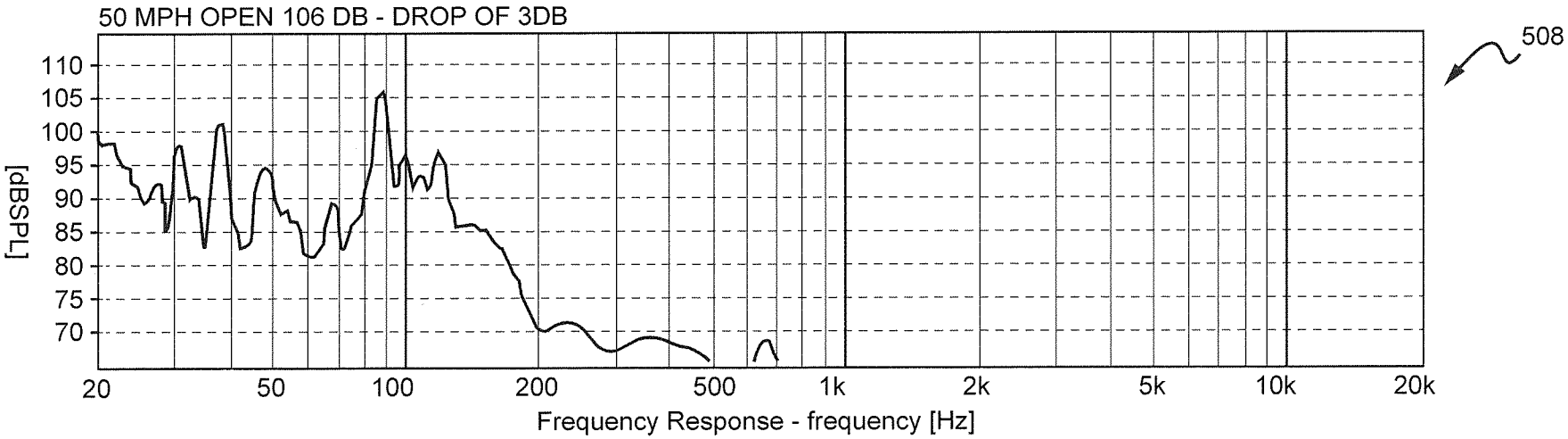
FIG. 5B is a graph illustrating acoustic data acquired from a test vehicle comprising the drone elimination muffler illustrated in FIG. 3 in an open state while the test vehicle operates at 50 MPH, according to the present disclosure.

FIG. 5A is a graph 504 illustrating acoustic data acquired from the drone elimination muffler 304, illustrated in FIG. 3, in the closed state with the test vehicle operating at 50 MPH on the dynamometer. The graph 504 comprises a plot of recorded sound power level (SPL), expressed in dB, as a function of acoustic frequency in Hz. FIG. 5B is a graph 508 which is substantially similar to the graph 504, with the exception that the drone elimination muffler 304 was placed in the open state. As shown in FIG. 5A, with the valve 120 in the closed state, a drone with an SPL of 109 dB was detected at a frequency of substantially 100 Hz. Upon opening the valve 120 to put the drone elimination muffler 304 into the open state, the SPL of the drone dropped to 106 dB at 100 Hz, as shown in FIG. 5B. Thus, with the test vehicle operating at 50 MPH, the drone elimination muffler 304 provides substantially a 3 dB attenuation in drone at 100 Hz.

Figure 6A:
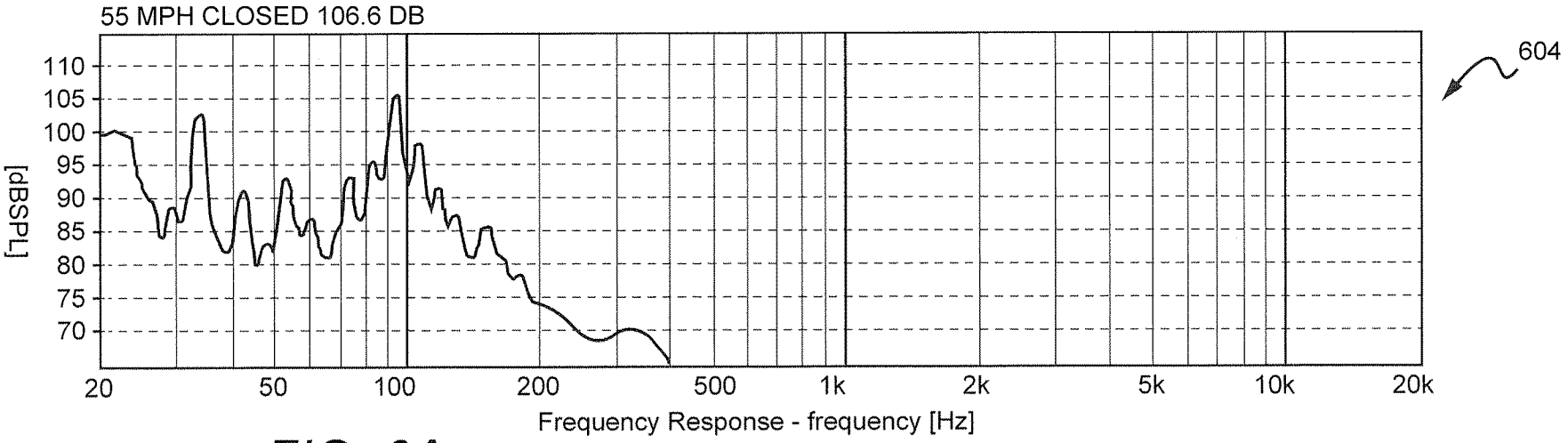
FIG. 6A is a graph illustrating acoustic data acquired from a test vehicle comprising the drone elimination muffler illustrated in FIG. 3 in the closed state while the test vehicle operates at 55 MPH in accordance with the present disclosure.
Figure 6B:
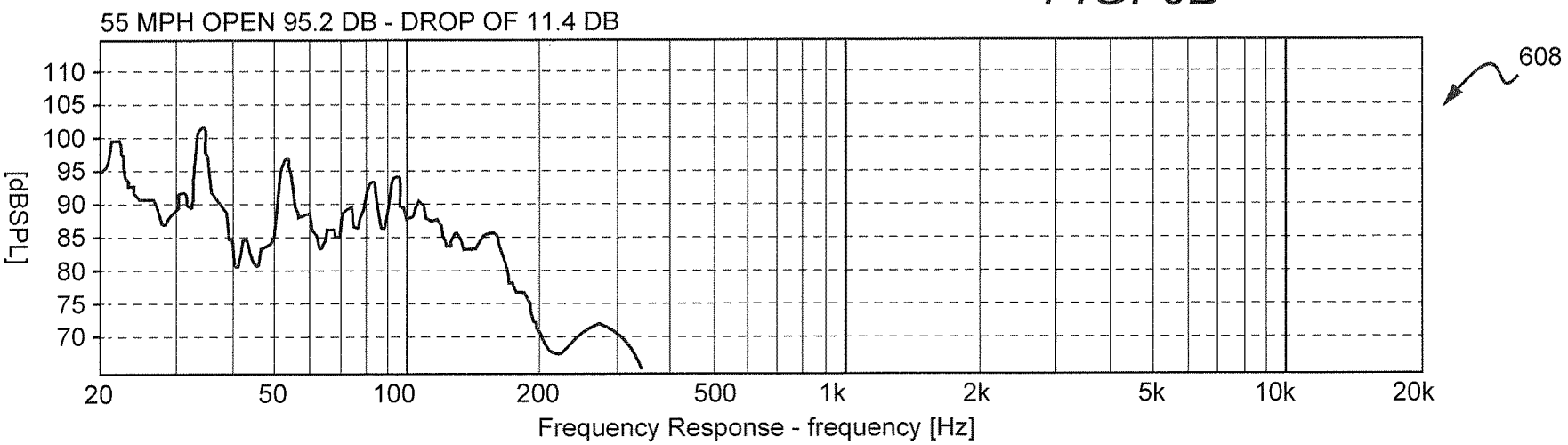
FIG. 6B is a graph illustrating acoustic data acquired from a test vehicle comprising the drone elimination muffler illustrated in FIG. 3 in the open state while the test vehicle operates at 55 MPH, according to the present disclosure.

FIG. 6A is a graph 604 which is substantially similar to the graph 504, with the exception that the acoustic data illustrated in the graph 604 was acquired with the test vehicle operating at 55 MPH on the dynamometer. With the drone elimination muffler 304 in the closed state, the drone at 100 Hz had an SPL of substantially 106.6 dB. With the valve 120 opened, putting the drone elimination muffler 304 into the open state, the drone was found to have an SPL of 95.2 dB, as shown in a graph 608 illustrated in FIG. 6B. FIGS. 6A-6B indicate, therefore, that opening the drone elimination muffler 304 while the test vehicle operates at 55 MPH leads to substantially an 11.4 dB decrease in drone at 100 Hz.

Figure 7A:
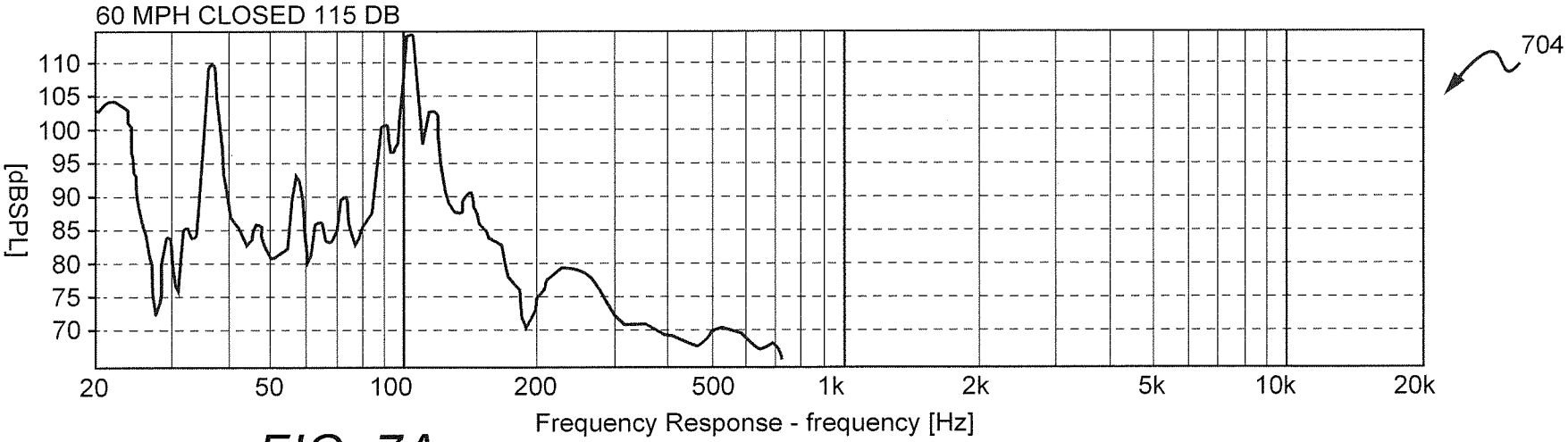
FIG. 7A is a graph illustrating acoustic data acquired from a test vehicle comprising the drone elimination muffler illustrated in FIG. 3 in the closed state while the test vehicle operates at 60 MPH in accordance with the present disclosure.
Figure 7B:
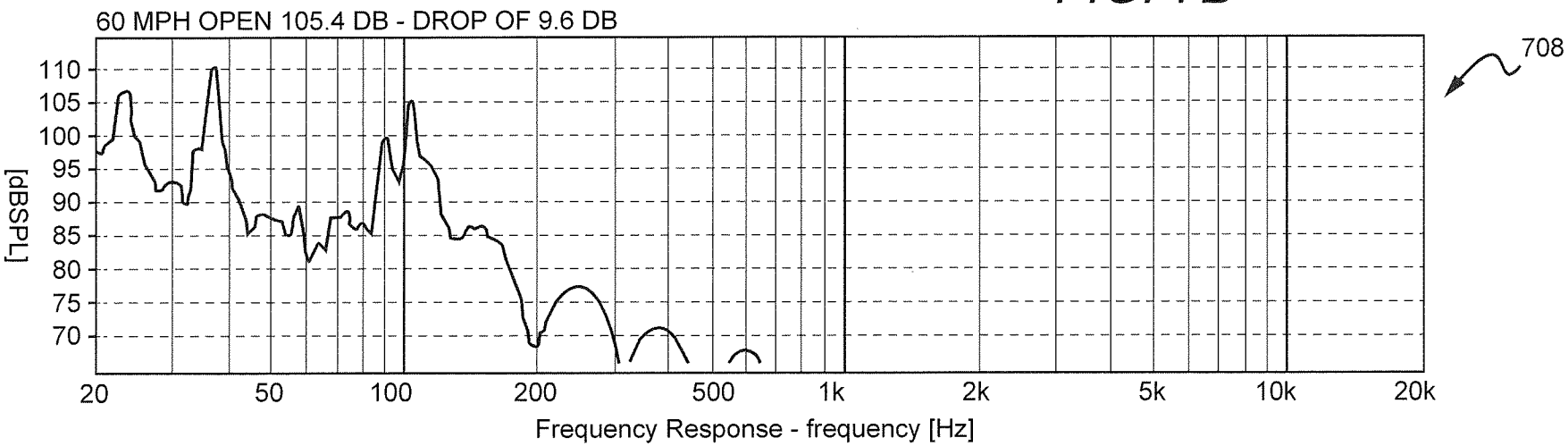
FIG. 7B is a graph illustrating acoustic data acquired from a test vehicle comprising the drone elimination muffler illustrated in FIG. 3 in the open state while the test vehicle operates at 60 MPH, according to the present disclosure.

FIG. 7A shows a graph 704 illustrating acoustic data acquired from the drone elimination muffler 304, in the closed state, while the test vehicle was operating at 60 MPH on the dynamometer. As shown in FIG. 7A, a drone having an SPL of 115 dB was detected at a frequency of 100 Hz. Upon putting the drone elimination muffler 304 in the open state, the drone at 100 Hz was found to have an SPL of 105.4 dB, as indicated in a graph 708 illustrated in FIG. 7B. FIGS. 6A-6B indicate that opening the drone elimination muffler 304 while the test vehicle operates at 60 MPH leads to substantially a 9.6 dB decrease in drone at 100 Hz.

Figure 8A:
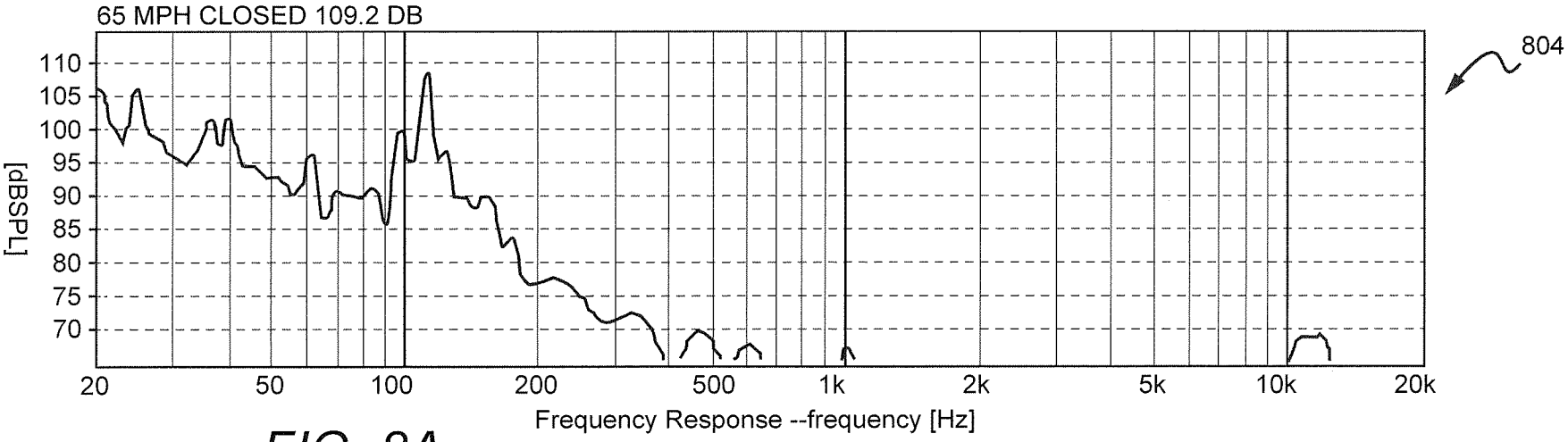
FIG. 8A is a graph illustrating acoustic data acquired from a test vehicle comprising the drone elimination muffler illustrated in FIG. 3 in the closed state while the test vehicle operates at 65 MPH, according to the present disclosure.
Figure 8B:
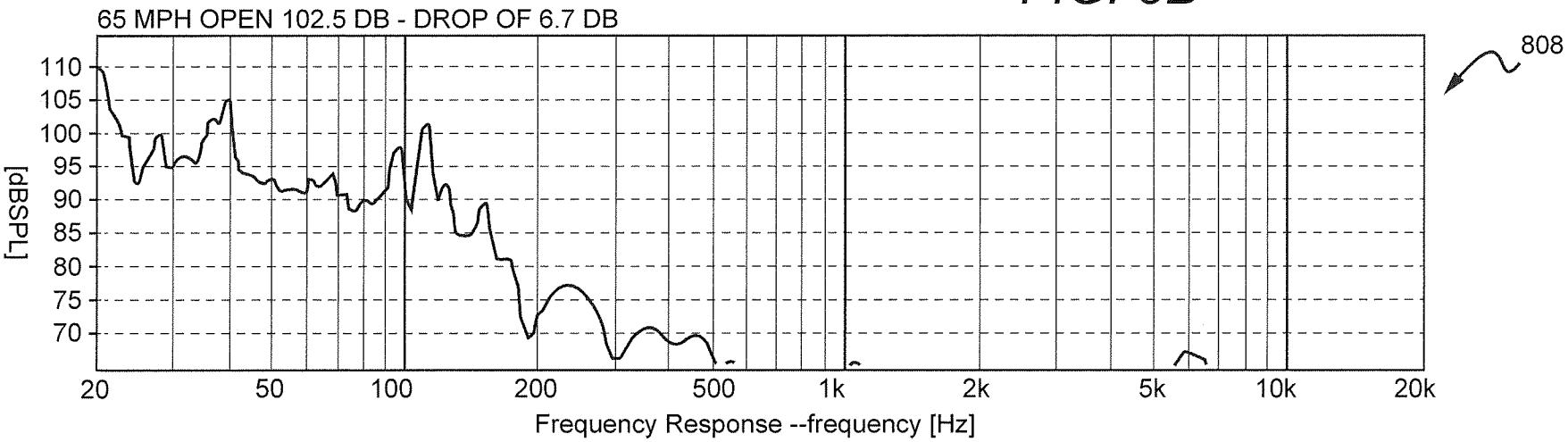
FIG. 8B is a graph illustrating acoustic data acquired from a test vehicle comprising the drone elimination muffler illustrated in FIG. 3 in the open state while the test vehicle operates at 65 MPH, according to the present disclosure.

FIG. 8A is a graph 804 which is substantially similar to the graph 704, with the exception that the acoustic data illustrated in the graph 804 was acquired with the test vehicle operating at 65 MPH on the dynamometer. With the drone elimination muffler 304 in the closed state, the drone at 100 Hz had an SPL of substantially 109.2 dB. With the valve 120 opened, putting the drone elimination muffler 304 into the open state, the drone was found to have an SPL of 102.5 dB, as shown in a graph 808 illustrated in FIG. 8B. FIGS. 8A-8B indicate, therefore, that opening the drone elimination muffler 304 while the test vehicle is operating at 65 MPH leads to substantially a 6.7 dB decrease in drone at 100 Hz.

Figure 9C:
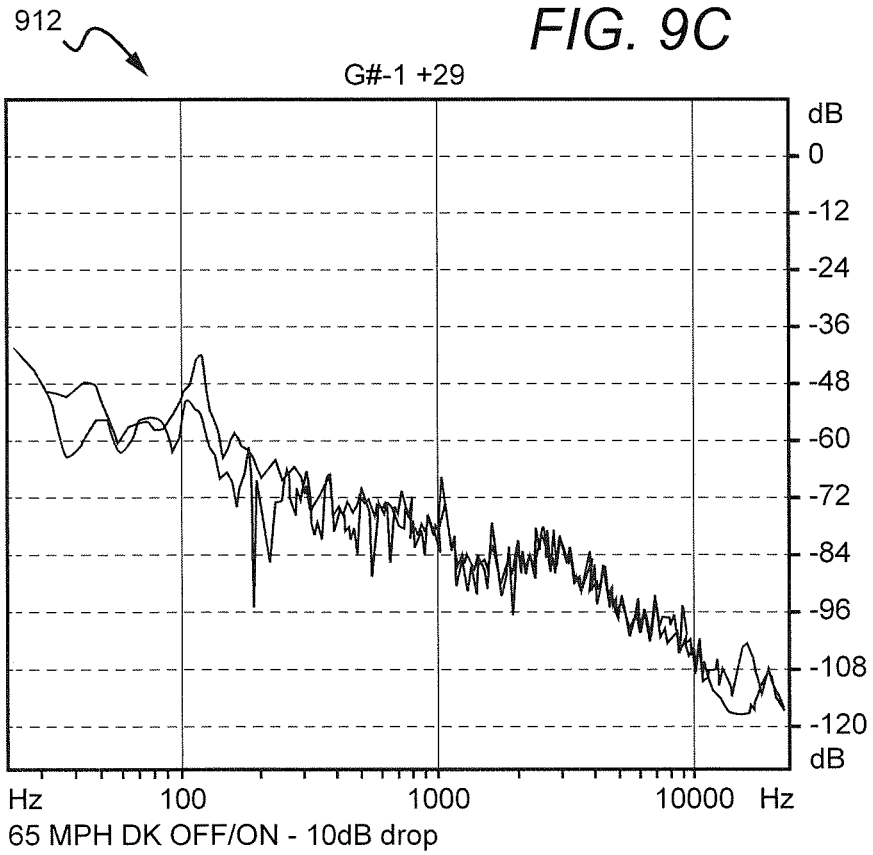
FIG. 9C is a graph illustrating a comparison of acoustic data acquired from a test vehicle comprising the drone elimination muffler illustrated in FIG. 3 in the closed state and the open state while the test vehicle operates at 65 MPH, according to the present disclosure.

FIGS. 9A through 9C each illustrate a comparison of a sound level detected inside the test vehicle with the drone elimination muffler 304 first in the closed state and then switched to the open state. FIGS. 9A-9C comprise plots of the sound level (dB) as a function of frequency (Hz) based on acoustic data collected by way of the above-mentioned 4-channel digital recorder and the microphones positioned inside of the test vehicle. FIG. 9A is a graph 904 illustrating the sound level inside the test vehicle while operating at 55 MPH on the dynamometer. FIG. 9A shows that a drone at a frequency of 100 Hz is reduced by substantially 6 dB upon opening the drone elimination muffler 304. FIG. 9B is a graph 908 which is substantially similar to the graph 904, with the exception that the acoustic data shown in graph 908 was captured while the test vehicle was operating at 60 MPH. As shown in FIG. 9B, a reduction in the drone at the frequency of 100 Hz is substantially 18 dB. Further, FIG. 9C is a graph 912 showing acoustic data captured while the test vehicle was operating at 65 MPH. FIG. 9C indicates that the drone at 100 Hz is reduced by substantially 10 dB upon opening the drone elimination muffler 304.

On the basis of the acoustic data illustrated in FIGS. 5A though 9C, one skilled in the art will appreciate that the drone elimination muffler 304 effectively decreases the sound level of exhaust drone within the test vehicle by substantially one half. The effectiveness of the drone elimination muffler 304 was found to vary with engine RPM, as well as exhaust gas temperature. It is envisioned that in some embodiments, the drone elimination muffler may be adjustable so as to facilitate advantageously tuning the drone elimination muffler to specific exhaust systems of vehicle, thus enabling a maximal attenuation of drone in each exhaust system. In some embodiments, the drone elimination muffler may be configured to respond to exhaust gas temperature changes so as to maximize attenuation of drone throughout the temperature range of the exhaust system. It is envisioned that in some embodiments, the first and second thermocouples may be utilized to respectively monitor the temperature of the canister and the tuned port so as to facilitate accurately responding to exhaust gas temperature changes. In some embodiments, the drone elimination muffler may include internal components configured to compensate for changes in engine RPM, such as by way of non-limiting example, pistons, springs, baffles, rings, dampers, joints, and the like, so as to maximize drone attenuation across a range of engine speeds. It should be understood, therefore, that the drone elimination muffler may be practiced with a wide variety of shapes, sizes, and features without deviating from the spirit and scope of the present disclosure. Further, it should be understood that, in some embodiments, the drone elimination muffler may be coupled with any of various active systems wherein exhaust drone may be controlled by way of destructive interference, such as by way of secondary noise sources.

While the invention has been described in terms of particular variations and illustrative figures, those of ordinary skill in the art will recognize that the invention is not limited to the variations or figures described. In addition, where methods and steps described above indicate certain events occurring in certain order, those of ordinary skill in the art will recognize that the ordering of certain steps may be modified and that such modifications are in accordance with the variations of the invention. Additionally, certain of the steps may be performed concurrently in a parallel process when possible, as well as performed sequentially as described above. To the extent there are variations of the invention, which are within the spirit of the disclosure or equivalent to the inventions found in the claims, it is the intent that this patent will cover those variations as well. Therefore, the present disclosure is to be understood as not limited by the specific embodiments described herein, but only by scope of the appended claims.

What is claimed is:

1. A drone elimination muffler to attenuate drone exhibited by exhaust systems, comprising:

a canister comprising a hollow cylindrical body having a length and a diameter;

a tuned port comprising (i) a first end connected to the canister and a second end connected to the exhaust system, such that the canister and the tuned port operate in concert to substantially attenuate exhaust drone at one or more frequencies of engine operation, wherein the second end is connected to the exhaust system at an outlet of a second muffler, and (ii) a damper clamped within a joint between the canister and the exhaust system, wherein the damper comprises a perforated stainless steel sheet; and a first thermocouple in thermal contact with the tuned port, the first thermocouple being configured to detect and monitor a temperature of the tuned port to facilitate maximizing attenuation of drone in the exhaust system by adjustably tuning the drone elimination muffler during exhaust gas temperature changes in concert with the damper.

2. The drone elimination muffler of claim 1, wherein the tuned port comprises a short, side mounted tuned port.

3. The drone elimination muffler of claim 2, wherein the damper comprises a 40% open perforated stainless steel sheet.

4. The drone elimination muffler of claim 1, wherein a valve is disposed between the second end and the exhaust system so as to enable switching the drone elimination muffler between a closed state in which the exhaust system operates without acoustic influence due to the drone elimination muffler, and an open state in which the drone elimination muffler directly influences the acoustic properties of the exhaust system.

5. The drone elimination muffler of claim 1, wherein the first thermocouple is in thermal contact with the tuned port, and a second thermocouple is in thermal contact with the canister, the first and second thermocouples being configured to respectively detect the temperature of the tuned port and a temperature of the canister.

6. The drone elimination muffler of claim 5, wherein the first and second thermocouples are configured to respectively monitor the temperature of the tuned port and the canister so as to facilitate responding to exhaust gas temperature changes.

7. The drone elimination muffler of claim 1, wherein the length is substantially 12 inches and the diameter is substantially 6 inches, and the tuned port comprises a length selected so as to attenuate a frequency of substantially 100 Hertz (Hz).

8. A method for attenuating drone exhibited by an exhaust system of an internal combustion engine, comprising:

providing a hollow canister having a length and a diameter suitable for use in a drone elimination muffler;

selecting a tuned port having a length and diameter suitable for operating in concert with the hollow canister to attenuate exhaust drone, wherein selecting the tuned port includes clamping a damper clamped within a joint between the hollow canister and the exhaust system, wherein the damper comprises a perforated stainless steel sheet;

connecting a first end of the tuned port to the canister and connecting a second end of the tuned port to the exhaust system, such that the canister and the tuned port substantially attenuate exhaust drone at one or more frequencies of engine operation, wherein the second end is connected to the exhaust system at an outlet of a second muffler; and thermally connecting a first thermocouple with the tuned port, the first thermocouple being configured to detect and monitor a temperature of the tuned port to facilitate maximizing attenuation of drone in the exhaust system by adjustably tuning the drone elimination muffler during exhaust gas temperature changes in concert with the damper.

9. The method of claim 8, wherein selecting the tuned port further comprises accounting for effects due to an operating temperature, or a temperature range, of the exhaust system.

10. The method of claim 8, wherein providing the hollow canister further comprises maximizing a size of the drone elimination muffler so as to increase an effective bandwidth of attenuation.

11. The method of claim 8, further comprising ensuring a natural frequency of the drone elimination muffler is substantially equal to an excitation frequency of the exhaust system so as to optimize attenuation of drone exhibited by the exhaust system.

12. The method of claim 11, further comprising ensuring the dimensions of the drone elimination muffler do not exceed substantially a quarter wavelength of the natural frequency of the drone elimination muffler so as to minimize any effects due to standing waves within the hollow canister.

13. The method of claim 8, wherein comprises at least a 40% open perforated stainless steel sheet.

14. The method of claim 8, further comprising placing a first thermocouple in thermal contact with the tuned port, and placing a second thermocouple in thermal contact with the hollow canister, the first and second thermocouples being configured to respectively detect a temperature of the tuned port and a temperature of the hollow canister.

15. The method of claim 14, further comprising configuring the first and second thermocouples to respectively monitor the temperature of the tuned port and the hollow canister for the purpose of optimizing attenuation of drone in the exhaust system during exhaust gas temperature changes.

16. The method of claim 8, further comprising incorporating a valve into the second end of the tuned port so as to enable switching the drone elimination muffler between a closed state in which the exhaust system operates in absence of influence due to the drone elimination muffler, and an open state in which the drone elimination muffler attenuates drone exhibited by the exhaust system.

* * * * *